US005868589A

United States Patent [19]

Swenson, Sr.

[11] Patent Number: 5,868,589

[45] Date of Patent: Feb. 9, 1999

[54] FUSEHOLDER AND CONNECTOR

[76] Inventor: Roger M. Swenson, Sr., Rt. #2, Box 49A, Williamsville, Mo. 63967

[21] Appl. No.: 869,892

[22] Filed: Jun. 5, 1997

Related U.S. Application Data

[63] Continuation-in-part of Ser. No. 720,912, Oct. 3, 1996, Pat. No. 5,695,369.

[51] Int. Cl.[6] ..... H01R 11/09

[52] U.S. Cl. ..... 439/784; 439/621; 337/187

[58] Field of Search ..... 439/754, 621; 337/186, 187

[56] References Cited

U.S. PATENT DOCUMENTS

| | | | |
|---|---|---|---|
| 2,056,248 | 10/1936 | Buchanan | 439/784 |
| 2,659,062 | 11/1953 | Tibbetts | 439/784 |
| 3,551,869 | 12/1970 | Robinson | 439/907 |

*Primary Examiner*—Steven L. Stephan
*Assistant Examiner*—T C Patel
*Attorney, Agent, or Firm*—Jim Zeeger, Esq.

[57] ABSTRACT

A fuse holder and connecting assembly for fusing a circuit and connecting two insulated wires (13, 14), comprising a pair of tubular housing members (15L, 15R), each housing member having a connection chamber, a fuse chamber and a conductive member (W1) extending between the connection chamber and the fuse chamber. The conductive member having a bullet shaped portion (23') located in the connection chamber and a fuse engaging portion (61) located in the fuse chamber. A clamp member (31') having externally threaded surface for threaded engagement with the threaded interior wall of the connection chamber. The clamp member also having a throughbore which is adapted to receive a wire end which is to be connected to the bullet shaped end of the conductive member and clamp the wire end in the connection chamber.

5 Claims, 2 Drawing Sheets

FUSEHOLDER AND CONNECTOR

REFERENCE TO RELATED APPLICATIONS

This application is a continuation-in-part of my application Ser. No. 08/720,912 filed Oct. 3, 1996, now U.S. Pat. No. 5,695,369 for QUICK MULTIPLE CONNECT ELECTRICAL CONNECTOR.

BACKGROUND OF THE INVENTION

In my application Ser. No. 08/720,912 I disclose a quick multiple connect electrical connector in which multiple blind connection chambers are provided. In a preferred embodiment of that invention, a bullet-shaped conductive member is fixedly secured in each connection chamber of a non-conductive female coupling, there being one connection chamber for each wire end to be connected. The internal walls of the connection chambers are threaded so that each connection chamber threadedly receives a non-conductive male coupling member. Each male coupling member has a bore therethrough which is shaped and configured similar to a bore and shaping of the non-conductive male coupling member as disclosed in my U.S. Pat. No. 5,228,875 for guiding the wire ends and clamping the wire ends to a common electrical conductor. The non-conductive male coupling member has a first end having a conically-shaped annular wall which is complementary to the conically-shaped or bullet end surface of the conductive metal connector member. The conically-shaped surfaces on the male coupling member and the metal conductor connector member are spaced a distance apart to receive the wire end so that when the bare end wires inserted into the bore, it is guided to the center of the bore and then splayed by the conically-shaped end surface of the metal connector and positioned between the spaced conical surfaces. Rotation of one of the male/female members relative to each other engages threads to reduce the distance and clamp the bare ends of the wire between the conical surfaces.

According to the present invention, the common connector member includes a fuseholder. According to the present invention, a pair of tubular housing members each having a connection chamber, a fuse chamber or portion thereof and a conductive member extending between the connection and fuse chamber, respectively. The conductive members have a bullet-shaped portion in the connection chamber and the fuse-engaging portion in the fuse chamber (or portion thereof). Thus, the non-conductive housing member is made in two parts with the housing having cooperating threaded ends (or other interlocking engagements), respectively, surrounding the fuse chamber portions.

Thus, the object of the invention is to provide an improved fuseholder and connector assembly for fusing a circuit and for connecting two insulated wires with the fuse assembly therebetween which is easy to use, results in secure wire clamping without use of tools of any kind and which is relatively low in cost.

DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1A:
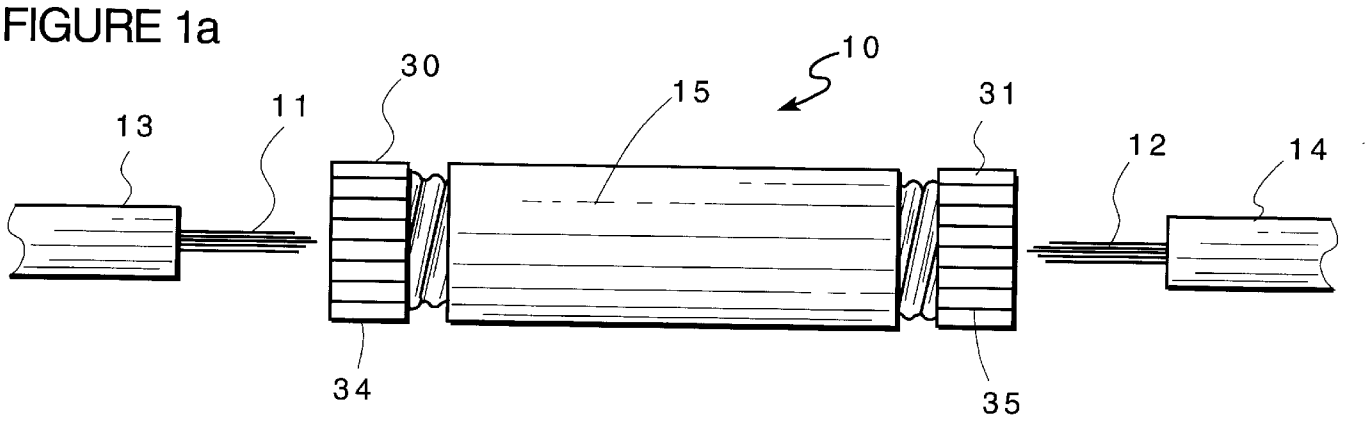
FIG. 1*a* is an external view of the connector disclosed in my above referenced copending patent application.
Figure 1B:
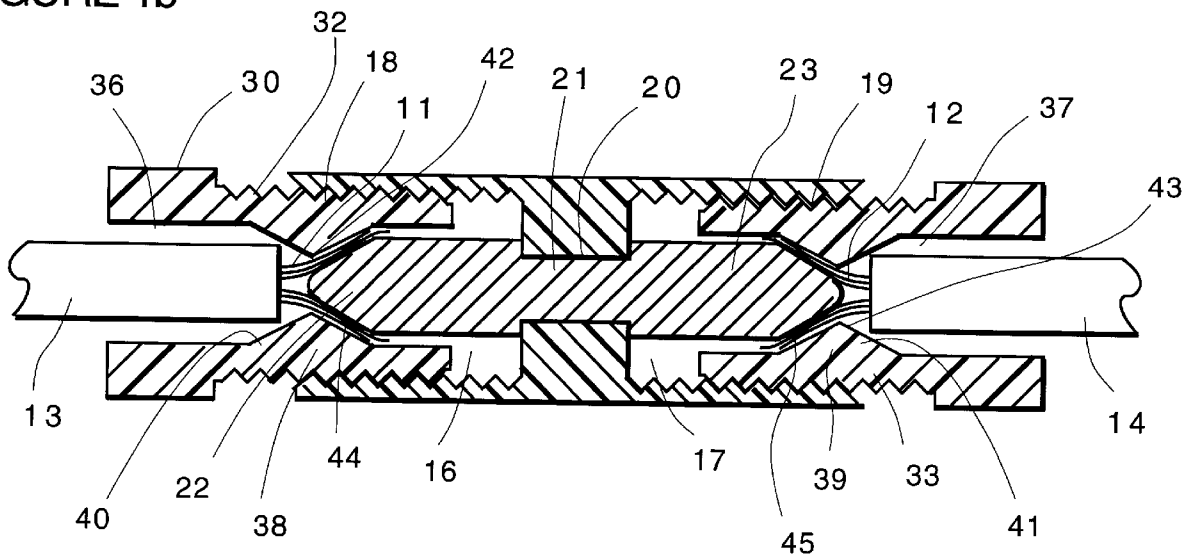
FIG. 1*b* is a sectional view showing the connector of my above referenced copending patent application with two wires coupled together thereby.

Referring to FIG. 1, an electrical connector 10 for connecting the bare ends of wires 11, 12 of the pair of wires 13, 14, respectively. It includes a non-conductive first coupling member 15 which may be circular, square, triangular or any other configuration. Non-conductive coupling member 15 forms a housing for connection chambers 16 and 17 (see FIG. 1*b*). Each of the connecting chambers has internally threaded walls 18 and 19, respectively, and a partition member 20 which mounts or secures a common metal connector member 21. The metal connector member 21 is fixedly mounted in partition 20 by being molded in, or glued in, or otherwise fixed in place. Common metal connector member 21 has a pair of bullet-shaped or conically-shaped projections 22, 23, respectively, which project into connection chamber 16 and 17, respectively.

A pair of non-conductive second coupling members 30 and 31 having externally threaded walls 32 and 33, respectively, and knurlated for finger grasp members 34, 35, respectively. The externally threaded walls 32 and 33 are threadedly engaged with internally threaded bores 18 and 19, respectively. Each of the non-conductive second coupling members 30 and 31 have a throughbore 36, 37, respectively, with an inwardly projecting member 38, 39. A first conical surface 40, 41 has an apex end 42, 43 constituting the narrows portion of the throughbore. The conical surfaces 40, 41 serve the function of guiding the loose wire strands to the apex end and thence upon the bullet ends 22, 23 of metal connector member 21. The opposite side of the apex end 43 includes a second conical surface 44, 45, respectively, which coact with the bullet or conically-shaped ends 22, 23 to form a clamp space into which the bare wire ends 11 and 12 are splayed and guided by the bullet-shaped ends 22, 23 of connection member 21. The apex end prevents the wire insulation from being jammed into the space between a first and second conically-shaped surface. Thus, when the bare wire ends of the electrical wires are inserted into the second end of the throughbore in the second coupling members, the bare wire end is guided off the central axis by the bullet-shaped end surface to be positioned between the conically-shaped surfaces. When the user grasps the members 34, 35 and rotates them in a direction to cause the coupling members 30 and 31 to move inwardly, the bare wire ends 11 and 12 are tightly gripped or clamped between the conically-shaped surfaces 44, 45 and the bullet-shaped ends, respectively. The wires 11 and 12 can be clamped simultaneously or separately. Knurlations may also be formed on the housing member 15. FIG. 1*b* shows the wire ends clamped in position in accordance with the invention.

The Present Invention

Figure 2:
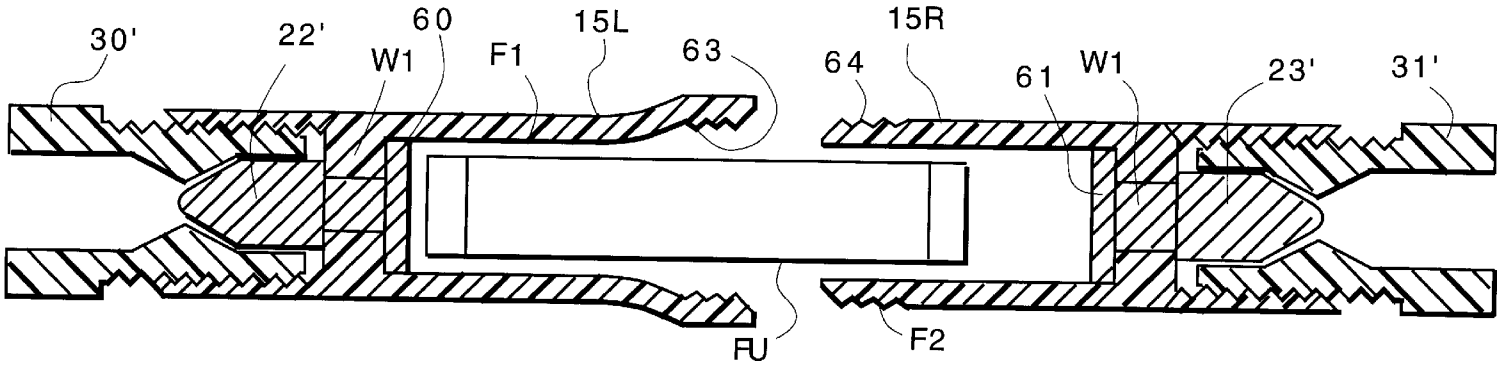
FIG. 2 is a sectional view of a fuseholder and connector assembly incorporating the present invention.
Figure 3:
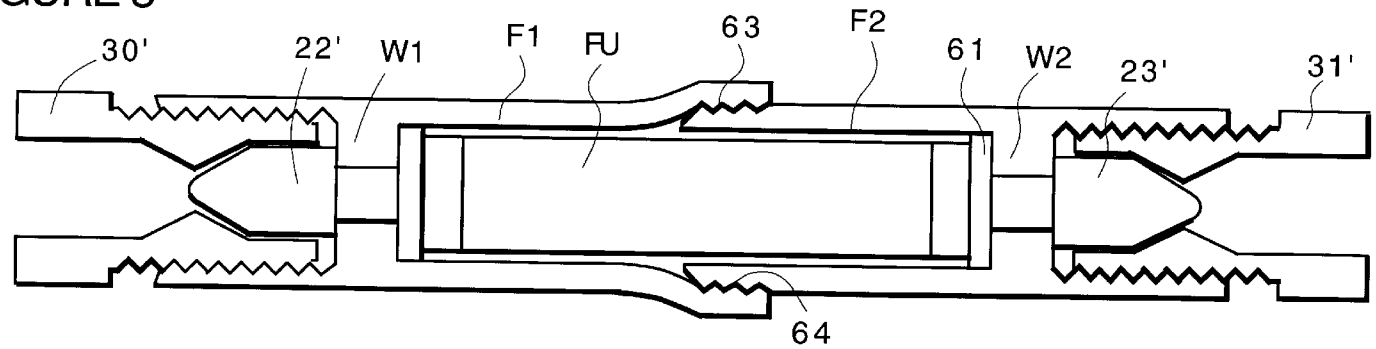
FIG. 3 is a sectional view showing the connector of FIG. 2 coupled together with the fuse in the fuse chamber.
Figure 4:
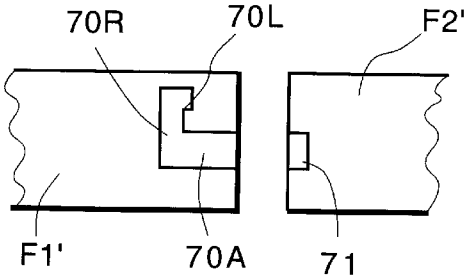
FIG. 4 illustrates an alternative embodiment of the interengagement of the fuse housing portions.

Referring now to FIGS. 2 and 3, like parts and corresponding to the disclosures of FIGS. 1*a* and 1*b* have been given prime numerals. The technique for clamping bare wire ends is identical to that described earlier and need not be repeated.

As illustrated, the bullet-shaped conductive elements have been provided as separate members, and the housing has been divided into two parts 15L and 15R, each of which has fuse chamber F1, F2. Each of the bullet-shaped conductive connection members 22', 23' is securely mounted in a wall W1, W2 and provided with a fuse-engaging portion or button 60, 61 which form the ends of fuse chambers F1 and F2. The fuse chambers, or fuse chamber portions F1 and F2, are provided with coacting coupling elements such as threaded portions 63, 64, respectively, so that when a fuse FU of a selected rating is fitted in the fuse chambers F1, F2 and the threads 63, 64 interengage and the circuit electrical conductivity between the buttons 60, 61 is completed through the fuse FU thereby fusing the circuit in which the wires are connected. It will be appreciated that instead of buttons 60, 61, spring fingers may be incorporated so that in the event the threaded engagement 63, 64 does not make secure conductive contact between buttons 60, 61 and the fuse element FU, the spring contacts will make that certain.

It will also be appreciated that instead of threaded coupling elements 63, 64, the walls of the fuse chamber portion F1' can have molded therein shaped slots 70 (one on each side) which has an axial section 70A, a rotary section 70R and a locking section 70L, and a coating protuberance 71 on the opposing fuse housing portion F2'. Protuberances 71 are fitted in slot portion 70 and the two chamber portions F1' and F2' pushed axially toward each other until protuberance 71 bottoms in the slot, then the fuse housing components rotated relative to each other so that protuberance 71 moves in slot portion 71R to the end of the slot and released to latch protuberance 71 in locking section 71L.

While a preferred embodiment of the invention has been described and illustrated, it will be appreciated that other embodiments and adaptations and changes to the invention will be readily apparent to those skilled in the art.

What is claimed is:

1. A fuseholder and connector assembly comprising:

a pair of housing members, each housing member having a connection chamber, a fuse chamber and a conductive member extending between said connection chamber and fuse chamber, said conductive member having a bullet-shaped portion in said connection chamber and a fuse-engaging member in said fuse chamber, said connection chamber having a threaded interior wall, a pair of male clamp members, each having an externally threaded surface for threaded engagement with said threaded interior wall of said connection chamber, each said male clamp member having a throughbore, one end of each throughbore being adapted to receive a wire end to be connected and adapted to cooperate with said bullet-shaped end in said connection chamber and clamp said wire end to be connected between said bullet-shaped end and a second end of said throughbore, each said housing member having cooperating interengaging securement ends, respectively.

2. A fuseholder and connector assembly for fusing a circuit and connecting two insulated wires comprising:

a pair of tubular housing members, each housing member having a connection chamber, a fuse chamber and a conductive member extending between said connection chamber and fuse chamber, said conductive member having a bullet-shaped portion in said connection chamber and a fuse-engaging portion in said fuse chamber, said connection chamber having a threaded interior wall, a clamp member having an externally threaded surface for threaded engagement with said threaded interior wall of said connection chamber, each said clamp member having a throughbore, one end of said throughbore being adapted to receive a wire end to be connected and adapted to cooperate with said bullet-shaped end and clamp said wire end in said connection chamber to be connected between said bullet-shaped end and a second end of said throughbore, each said tubular housing member having cooperating threaded ends, respectively, surrounding said fuse chambers, respectively.

3. A fuse connector for fusing an electrical circuit and splicing the free ends of two or more flexible electrical wires in said electrical circuit comprising:

a non-conductive body member having a fuse chamber and at least a pair of connection chambers, each connection chamber having a threaded bore, respectively, a common conductive means, said common conductive means having:

(a) at least a pair of rounded tip protrusions, one rounded tip protrusion extending into one connection chamber, respectively, (b) a central portion fixedly secured in said non-conductive body member, and (c) a fuse contact portion in said fuse chamber, at least a pair of hollow non-conductive male members, each hollow non-conductive male member having an inner surface shaped complementary to the shape of said rounded tip protrusion, and a threaded external surface portion for threaded engagement with said threaded bore, respectively, said fuse chamber being constituted by two portions which are interlockingly coupled together, whereby the respective free ends of said two or more flexible wires can be received in said connection chambers, respectively, and each of said at least a pair of hollow non-conductive male members are threadably engaged with said threaded bores for clampingly engaging said ends of said two or more flexible electrical wires between said complementary shaped surfaces and said rounded tips, respectively, when said hollow non-conductive male members are axially moved relative to said body member and a fuse in said fuse chamber is electrically connected to said common conductive means.

4. A fuseholder and wire connector assembly comprising:

a pair of tubular housing members, each having a wire connection chamber, a fuse chamber portion and a conductive member extending between said wire connection chamber and said fuse chamber portion, respectively, each said conductive member having a bullet-shaped portion in each connection chamber, respectively, and a fuse-engaging portion in the fuse chamber portion, respectively, and means for clamping a bare wire end to said bullet-shaped portions, respectively.

5. The fuseholder and wire connector assembly defined in claim 4 wherein said means for clamping includes a threaded clamp member and a threaded interior wall on each said connection chamber in threaded engagement with said threaded clamp member.

* * * * *